United States Patent [19]

Bruninga

[11] Patent Number: 4,892,252

[45] Date of Patent: Jan. 9, 1990

[54] ADJUSTABLE PART CIRCLE SPRINKLER ASSEMBLY

[75] Inventor: Kenneth J. Bruninga, Mapleton, Ill.

[73] Assignee: L. R. Nelson Corporation, Peoria, Ill.

[21] Appl. No.: 266,532

[22] Filed: Nov. 3, 1988

[51] Int. Cl.[4] ..... B05B 3/04

[52] U.S. Cl. ..... 239/205; 239/206; 239/240; 239/288.5; 239/600

[58] Field of Search ..... 239/203–206, 239/240, 241, 242, 288, 288.3, 288.5, 600

[56] References Cited

U.S. PATENT DOCUMENTS

| | | | |
|---|---|---|---|
| 1,919,196 | 7/1933 | Brooks | 239/240 |
| 3,602,431 | 8/1971 | Lockwood | 239/206 |
| 3,930,618 | 1/1976 | Lockwood | 239/241 |
| 4,253,608 | 3/1981 | Hunter | 239/206 |
| 4,353,506 | 10/1982 | Hayes | 239/206 |
| 4,417,691 | 11/1983 | Lockwood | 239/206 |
| 4,448,353 | 5/1984 | Livne | 239/205 |
| 4,624,412 | 11/1986 | Hunter | 239/206 |
| 4,625,914 | 12/1986 | Sexton et al. | 239/206 |

*Primary Examiner*—Andres Kashnikow

*Assistant Examiner*—Michael J. Forman

*Attorney, Agent, or Firm*—Cushman, Darby & Cushman

[57] ABSTRACT

An adjustable part circle sprinkler assembly including a sprinkler body structure and a sprinkler head structure mounted thereon for rotational movement in either direction about an upright axis. An interior water flow path from an inlet in the body to a stream discharging outlet in the head includes nozzles directing streams onto a reversible flow directing mechanism for driving an impeller selectively in either direction. The impeller is connected with the head to rotate the same by a gear driven speed reducer and a slip clutch. A part circle pattern control assembly is mounted in an open top of the head closed by a conveniently removable anti-vandal cap structure. The pattern control assembly cooperates with a lever and resilient post reversing mechanism for the reversible flow directing mechanism. Manual movements of the head are accommodated by the slip clutch which protects the gear driven speed reducer. The control assembly serves to automatically return the head to operation within the selected pattern when moved manually therefrom.

34 Claims, 6 Drawing Sheets

Fig. 3.
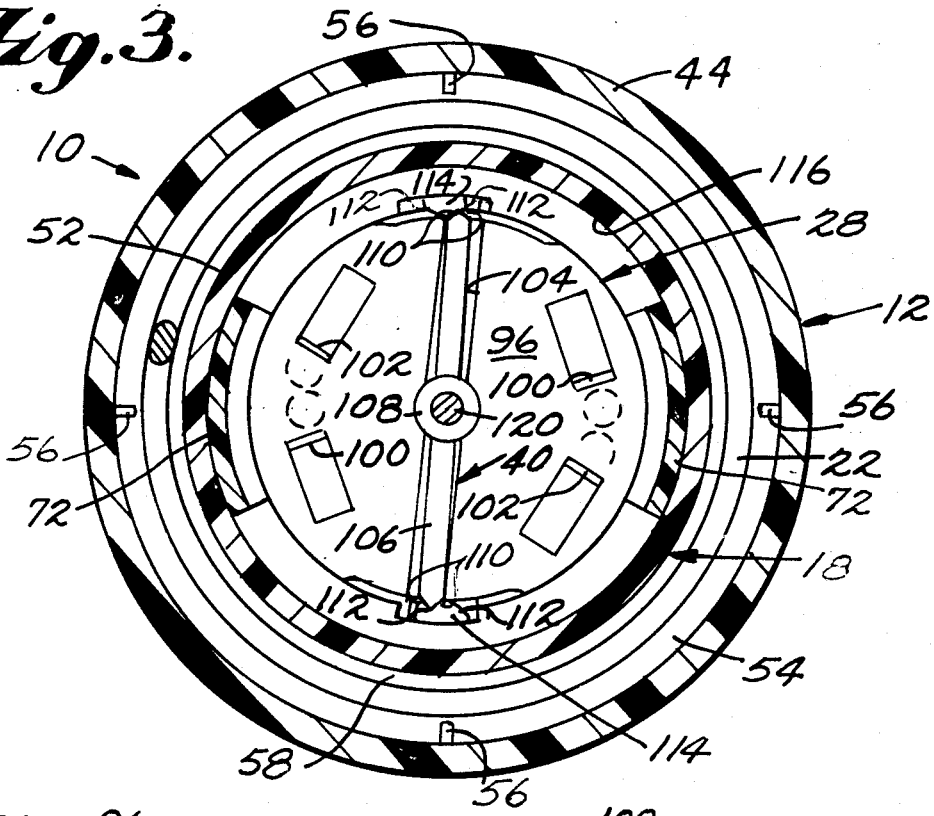
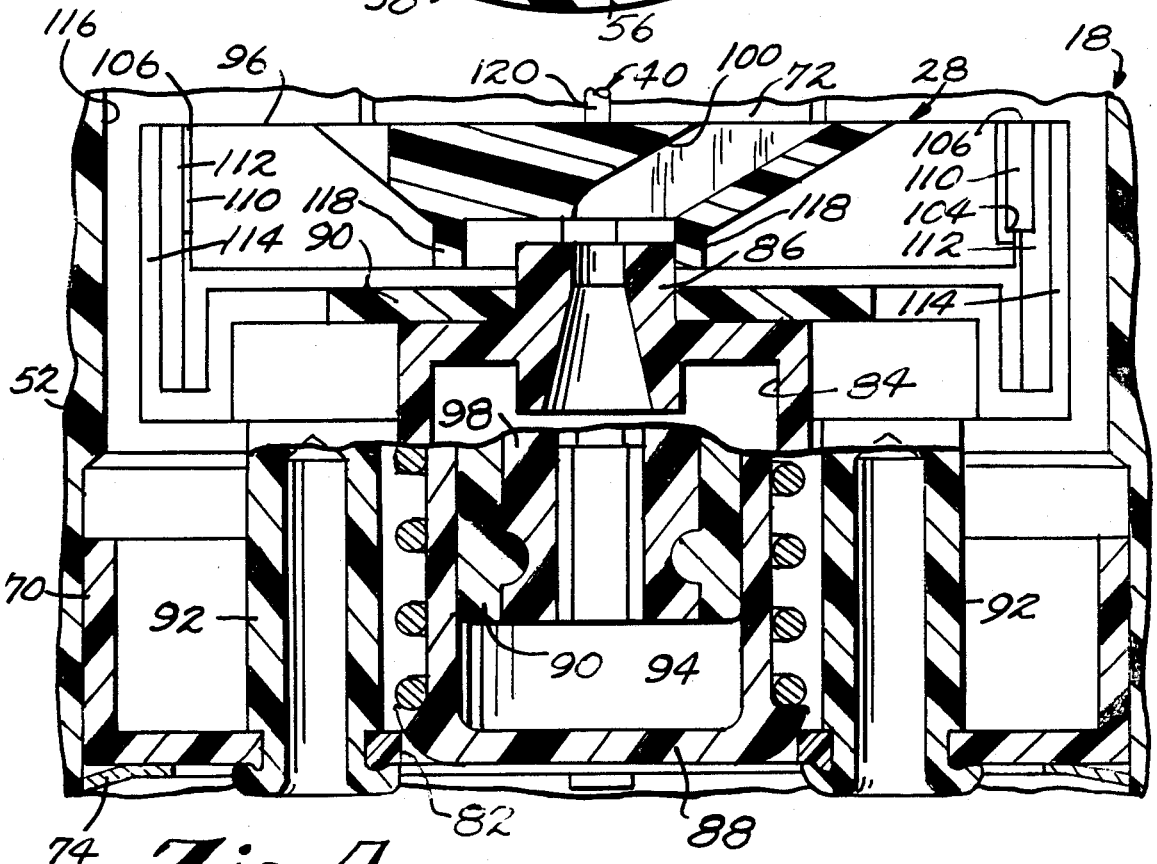
Fig. 4.

ADJUSTABLE PART CIRCLE SPRINKLER ASSEMBLY

This invention relates to sprinklers and more particularly to sprinklers of the adjustable part circle type.

Adjustable part circle sprinklers are well known in the prior art. A significant use of adjustable part circle sprinklers is in sprinkler systems for lawns and the like. The desirability of an adjustable part circle sprinkler is that for any given installation the same units may be utilized irrespective of their positions. In the usual situation, different sprinklers in the system will be adjusted to provide different part circle patterns. For example, a sprinkler at a corner would be adjusted to provide a 90° part circle pattern in operation. Similarly, a sprinkler which is positioned along one boundary of the lawn would be adjusted to provide a 180° part circle pattern. Likewise, where particular situations are presented, other segmental patterns can be achieved by adjusting the part circle sprinkler. In most systems, the sprinkler heads are of the pop-up variety although fixed sprinkler heads providing adjustable part circle patterns can be used in many systems.

Known adjustable part circle sprinklers are characterized by the type of drive utilized. Both external and internal drives are provided. Internal drives may be unidirectional or reversible. Reversible drives have the advantage that the entire flow of water through the sprinkler can be directed in a single stream which has the advantage of reaching the greatest coverage area. Reversible drives have been both of the continuous movement type and of the intermittent movement type. Examples of intermittent movement reversible drives are disclosed in U.S. Pat. Nos. 3,602,431, 3,930,618, and 4,625,914. Examples of continuous movement reversible drives are disclosed in U.S. Pat. Nos. 4,253,608, 4,417,691, and 4,624,412. Continuous movement reversible drives are advantageous in that they are quieter than intermittent movement reversible drives. Continuous movement reversible drives are positively acting and hence more efficient. In contrast, intermittent movement reversible drives are not positive in their operation so that the sprinkler head which directs the stream is capable of being easily moved manually out of its operating position. Indeed, this situation is so prevalent in intermittent movement reversible drives that at least one manufacturer of such a unit, Safe-T Lawn-/Moody, has since as early as 1976 offered an automatic reset device or "memory clutch" as an option for their Safe-T Rain part circle series sprinklers. With the automatic reset device installed in the unit, an inadvertent turning of the sprinkler head out of its set part circle limits does not have the effect of changing the position or extent of the part circle limits. Instead, the unit which has been moved outside the limits operates initially to move itself back into the operating limits and to maintain itself thereafter within the limits. A similar functional capability is disclosed in U.S. Pat. No. 4,625,914.

While the positive action of a continuous movement reversible drive resists movement of the sprinkler head out of its operating limits, it has been found that, on occasion, this positive action is not a sufficient deterrent to vandals or the like. Indeed, on occasion, a forced turning of the sprinkler head by vandals has resulted in injury to the continuous drive.

It is an object of the present invention to provide an adjustable part circle sprinkler of the reversible internal drive type which obtains all of the advantages of both the continuous and intermittent movement reversible drives without the disadvantages of either. In accordance with the principles of the present invention, this objective is obtained by providing an adjustable part circle sprinkler assembly which comprises a sprinkler body structure having an inlet means for communication with a source of water under pressure and a sprinkler head structure mounted on the sprinkler body structure for rotational movement about an upright axis either in one direction or an opposite direction. The sprinkler structures define a sealed flow path for water under pressure communicated with the inlet including an outlet in the sprinkler head structure for discharging the water in an upwardly and outwardly extending stream formation so as to be dispersed in an instantaneous generally segmental ground pattern within a circular ground pattern. Included within the flow path is an annular chamber and a reversible flow-directing mechanism is mounted in the sprinkler body structure for movement between (1) a first position for directing water in the flow path into the chamber in one annular direction and (2) a second position for directing water in the flow path into the chamber in an opposite annular direction. An impeller is mounted in the chamber for rotation by the flow of water in the chamber in an direction corresponding to the annular direction of movement of the water into the chamber. A meshing gear speed reduction assembly is drivingly connected with the impeller and includes a rotary output member rotatable in a direction commensurate with the direction of rotation of the impeller and at a speed commensurately less than the speed of rotation of the impeller, the operation being such that the output member cannot be rotationally moved when the impeller is stationarily inoperable. A slip clutch serves to operatively connect the rotary output member with the sprinkler head structure for (1) normally operable rotational movement commensurate with the rotational movement of the rotary output member and (2) manual rotational movement in either direction without a commensurate movement of the rotary output member. A part circle pattern control assembly is operatively connected with the reversible flow-directing mechanism and the sprinkler head structure which is operable first to adjustably predetermine the limits of the part of the circular ground pattern within which the instantaneous generally segmental ground pattern of the water is moved in opposite directions by corresponding opposite movements of the sprinkler head structure through positions within such limits and second, when the sprinkler head structure is manually moved as permitted by the slip clutch into a position beyond the predetermined limits, to enable the sprinkler head structure to be moved in response to the rotational movement of the impeller back within the limits for continued normal movements in opposite directions within the limits. With the capabilities noted above, the driving mechanism is of the continuous reversible type with its attendant advantages, while at the same time, the disadvantages of damage due to vandalized manual turning of the sprinkler head is prevented and the convenience of automatic return is secured.

The reversing mechanism of reversible drives whether of the intermittent motion type or of the continuous motion type constitutes a significant cost factor in the overall cost effectiveness of reversible part circle sprinkler assemblies. There is always the need to make assemblies of this type more cost effective.

Accordingly, it is a further object of the present invention to fulfill the above-noted need by providing an improved reversing mechanism for an adjustable part circle sprinkler assembly comprising a sprinkler body structure having an inlet for communication with a source of water under pressure and a sprinkler head structure mounted on the sprinkler body structure for rotational movement about an upright axis either in one direction or an opposite direction. The sprinkler structures define a sealed flow path for water under pressure communicated with the inlet including an outlet in the sprinkler head structure for discharging the water in an upwardly and outwardly extending stream formation so as to be dispersed in an instantaneous generally segmental ground pattern within a circular ground pattern. The flow path includes an annular chamber and reversible flow-directing assembly is mounted in the sprinkler body structure for movement between (1) a first position for directing water in the flow path into the chamber in one annular direction and (2) a second position for directing water in the flow path into the chamber in an opposite annular direction. A drive assembly is operatively associated with the flow of water in the chamber and with the sprinkler head structure for effecting rotational movements of the sprinkler head structure in opposite directions depending upon which of the opposite directions the water is directed into the chamber. The improved reversing mechanism serves to (1) move the flow-directing assembly from the first position thereof into the second position thereof when the sprinkler head reaches a first predetermined limiting position and (2) move the flow directing assembly from the second position into the first position when the sprinkler head reaches a second predetermined limiting position. The improved reversing mechanism comprises a lever mounted for oscillating movement through successive operating cycles each of which includes a first operative stroke in one direction and a second operative stroke in the opposite direction. A mechanism is provided for moving the lever (1) through an initial portion of its first operative stroke in response to the movement of the sprinkler head structure through a corresponding movement into its first predetermined limiting position and (2) through an initial portion of its second operative stroke in response to the movement of the sprinkler head structure through a corresponding movement into its second predetermined limiting position. A cam is mounted for biased movement from a second position into a first position and for movement against such bias from its first position into its second position and the lever has cam surfaces thereon for effecting (1)

from its first position into its second position against the bias thereof in response to the movement of the lever through its initial portion of its first operative stroke so that the subsequent biased movement of the cam from its second position into its first position moves the lever rapidly through a final portion of the first operative stroke thereof and (2) movement of the cam from its first position into its second position against the bias thereof in response to the movement of the lever through the initial portion of its second operative stroke so that the subsequent biased movement of the cam means from its second position into its first position moves the lever rapidly through a final portion of the second operative stroke thereof. A mechanism is provided for effecting reversing movements of the reversible flow directing assembly between the first and second positions thereof in response to the rapid movements of the lever through the final portions of the first and second strokes thereof.

While the 1976 "memory clutch" marketed by Safe-T Lawn/Moody could be utilized in the adjustable part circle sprinkler assembly embodying the present invention, it is a further object of the present invention to provide an automatic resetting device or pattern control assembly which is more cost effective. In accordance with the principles of the present invention, this objective is obtained by providing a pattern control assembly for an adjustable part circle sprinkler assembly including a sprinkler head having an inlet for communication of water under pressure therewith. A sprinkler head mounted on the sprinkler body for rotational movement about an upright axis and having an outlet for directing water communicated with the inlet in an upwardly and outwardly extending stream formation so as to be dispersed in an instantaneous generally segmental ground pattern within a circular ground pattern, and a reversible drive operable by the water flowing through the sprinkler body and head between the inlet and the outlet for moving the sprinkler head about its upright axis in either direction. The pattern control assembly is operable to cooperate with the reversible drive to determine the direction and extent of movement of the sprinkler head to thereby determine the direction and extent the instantaneous generally segmental ground pattern of the dispersed water is moved within the circular pattern. The pattern control assembly is further operable after the sprinkler head has been manually moved beyond either determined extent of movement to automatically return the sprinkler head within the determined extents of movement during subsequent operation. The pattern control assembly comprises an outer annular member having annular exterior peripheral surfaces and annular interior surfaces and an inner member mounted for annular movement in one direction and in an opposite direction in cooperating relation with the reversible drive of the sprinkler assembly so that (1) a predetermined annular movement of the inner member in one direction is operable to effect a reversal of the reversible drive so as to reverse the movement of the sprinkler head of the sprinkler assembly and the instantaneous generally segmental ground pattern of the discharged water from one direction to an opposite direction and (2) a predetermined annular movement of the inner member in an opposite direction is operable to effect a reversal of the reversible drive to reverse the movement of the sprinkler head of the sprinkler assembly and the instantaneous generally segmental ground pattern of the discharged water from the opposite direction to the one direction. The inner member has annularly arranged resiliently yieldable fingers operable in response to a relative axial movement between the inner and outer members from separate positions into cooperating positions to cooperate with the interior peripheral surfaces of the outer member to retain the members in their cooperating positions. First and second adjustable members are mounted on the exterior peripheral surfaces of the outer member for (1) selective annular movement with respect to the outer member by manual adjustment into any selected one of a multiplicity of different part circle pattern defining positions and (2) annular motion transmitting relation with respect to the outer member so that (A) movement of the sprinkler head in the one direction into the first member transmits a corresponding annular movement to the outer member in one direction and (B) movement of the sprinkler head in the opposite direction into the second member transmits a corresponding annular movement to the outer member in an opposite direction. Interengaging surfaces between the spring finger and the interior peripheral surfaces of the outer annular member are operable to be (1) engageable to transmit operative sprinkler head causing annular movements of the outer member in either direction to corresponding movements of the inner member and (2) yieldably disengageable in response to manually caused overriding annular movements of the outer member in either direction so as to enable the outer member to be manually moved relative to the inner member.

The prior art "memory clutch" was provided in the sprinkler head, but in order to operate it, the operator had to remove a cap or cover plate from the top of the sprinkler head. The cover plate was secured in position by two screws. The screwed-down cap required a tool for removal which presented an undesirable inconvenience in operation but a desirable deterrent to vandalism.

A further object of the present invention is to provide an improved cap construction for a sprinkler head of the type described which is capable of being conveniently removed without the need for tools but yet has a desirable deterrent to vandalism. In accordance with the principles of the present invention, this objective is obtained by providing an adjustable part circle sprinkler assembly comprising a sprinkler body having an inlet for communication of water under pressure therewith and a sprinkler head mounted on the sprinkler body means for rotational movement about an upright axis and having an outlet for directing water communicated with the inlet in an upwardly and outwardly extending stream formation so as to be dispersed in an instantaneous generally segmental ground pattern within a circular ground pattern. A reversible drive is provided which is operable by the water flowing through the sprinkler body and the sprinkler head between the inlet and the outlet for moving the sprinkler head about the upright axis in either direction. The sprinkler head includes a tubular top portion defining an interior space opening upwardly and a manually adjustable mechanism is positioned within the interior space cooperable with the reversible drive to determine the direction and extent of movement of the sprinkler head to thereby determine the direction and extent the instantaneous generally segmental ground pattern of the dispersed water is moved within the circular pattern. The improved cap construction includes a cap structure mounted for (1) engagement with the tubular top portion in closing relation with the upwardly opening interior space thereof and (2) removal from the tubular top portion so as to permit manual access to the adjustable mechanism within the interior space. The mounting of the cap structure comprises interengaging lugs on the cap structure and the tubular top portion for (1) enabling the cap structure to be engaged with the tubular top portion in closing relation with respect to the upwardly opening interior space thereof in such a way that the cap structure is generally unrestrictively rotatable in either direction so as to permit unwanted manual rotation thereof without a commensurate rotational movement of the tubular top portion and (2) enabling the cap structure to be disengaged from the tubular top portion to expose the upwardly opening interior space thereof by a manual prying action only when the cap structure is within a limited range of annular positions with respect to the tubular top portion.

These and other objects of the present invention will become more apparent during the course of the following detailed description and appended claims.

The invention may best be understood with reference to the accompanying drawings wherein an illustrative embodiment is shown.

IN THE DRAWINGS:

FIG. 3 is a sectional view taken along the line 3—3 of FIG. 2;

FIG. 4 is an enlarged fragmentary sectional view taken along the line 4—4 of FIG. 2;

Figure 1:
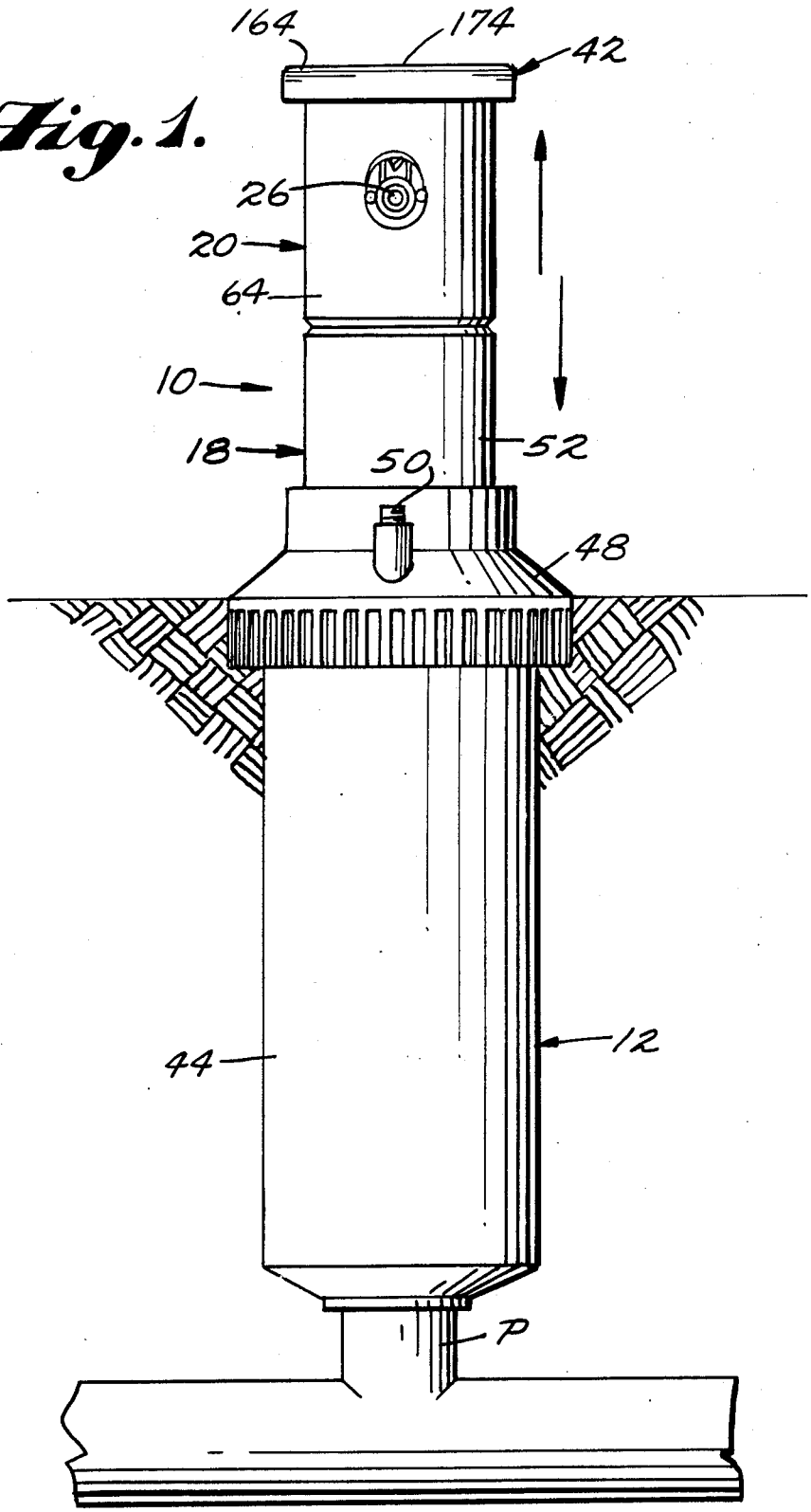
FIG. 1 is a side elevational view of an adjustable part circle sprinkler assembly embodying the principles of the present invention, showing the same installed in a popped-up operating position.
Figure 2:
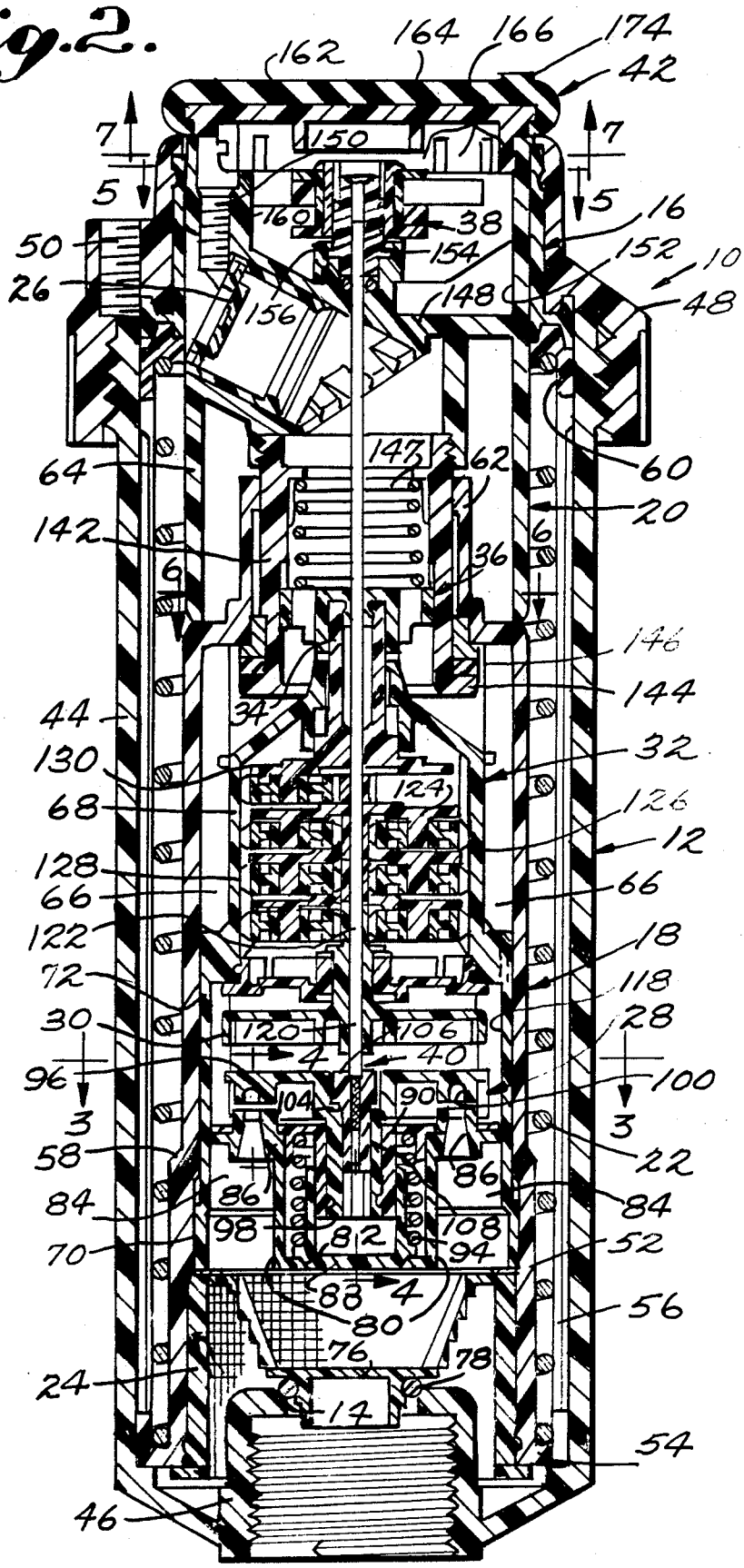
FIG. 2 is a vertical sectional view of the sprinkler assembly in its lowered storage position.
Figure 5:
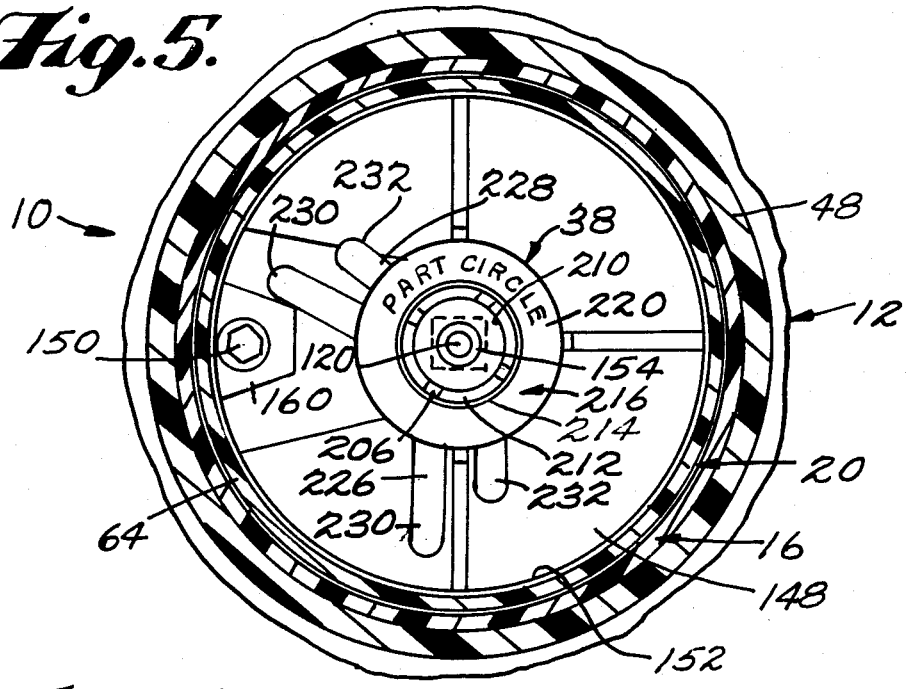
FIG. 5 is a sectional view taken along the line 5—5 of FIG. 2.

Referring now more particularly to the drawings, there is shown therein an adjustable part circle sprinkler assembly, generally indicated at 10, which embodies the principles of the present invention. In the form shown, the sprinkler assembly 10 is of the pop-up type, although it will be understood that the principles of the present invention are equally applicable to fixed type adjustable part circle sprinkler assemblies. The pop-up sprinkler assembly 10 shown includes the usual outer casing structure, generally indicated at 12, which provides an inlet opening 14 for communication of water under pressure therewith. Mounted within the upper interior end of the casing structure 12 is an annular seal assembly, generally indicated at 16, which cooperates with a sprinkler body structure, generally indicated at 18, and a sprinkler head structure, generally indicated at 20, both of which are mounted within the casing structure 12 for movement between a lowered storage position, as shown in FIG. 2, and a popped-up operative position, as shown in FIG. 1. A coil spring 22 is mounted within the casing structure 12 between the seal assembly 16 and the lower end of the sprinkler body structure 18 so as to resiliently bias the latter together with the sprinkler head structure 20 into their lowered storage position.

The interior of the sprinkler body structure 18 and the interior of the sprinkler head structure 20, which is mounted for rotational movement thereon in either direction about an upright axis, are configured to provide a flow path for the water under pressure which passes through the inlet 14 of the casing structure 12. The inlet of the flow path is defined by a sieve or screen member 24 in the sprinkler body structure 18 and the outlet is defined by an outlet nozzle member 26 in the sprinkler head structure 20. Included within the flow path within the sprinkler body structure 18 is a reversible flow-directing mechanism, generally indicated at 28, which serves to reverse the direction of water flow onto an impeller 30. The impeller 30 drives a meshing gear speed reduction assembly, generally indicated at 32, which includes a rotary output member 34 rotatable in a direction commensurate with the direction of the rotation of the impeller 30. The rotary output member 34 is connected by a slip clutch mechanism, generally indicated at 36, with the sprinkler head structure 20, the slip clutch mechanism 36 normally being operable to transmit rotational movements to the sprinkler head structure 20 commensurate with the rotational movements of the rotary output member 30 but to permit manual rotational movements of the sprinkler head structure 20 in either direction without a commensurate movement of the rotary output member 32. Mounted within an open upper end of the sprinkler head structure 20 is a part circle pattern control assembly, generally indicated at 38, which is connected through a reversing mechanism, generally indicated at 40, to the reversible flow-directing mechanism 28 in the sprinkler body structure 18. The open upper end of the sprinkler head structure 20 is closed by a removable cap structure, generally indicated at 42.

Referring now more particularly to FIG. 2, the casing structure 12 includes a main tubular casing member 44 which is molded of a suitable plastic material. The lower end of the casing member 44 is necked down and includes a cylindrical wall 46 which is internally threaded to receive a pipe P of a underground sprinkler system which contains water under pressure. The upper end of the cylindrical wall is interiorly flanged to provide the inlet 14. The annular seal assembly 16 is carried within an annular cap 48 which is threaded onto the upper end of the casing member 44. A set screw 50 serves to rigidify the connection.

The sprinkler body structure 18 includes an outer tubular body member 52 molded of a suitable plastic material to provide an outer radially outwardly extending flange 54 on its lower end for receiving the lower end of the spring 22. The flange 54 is formed with a series of slots which are adapted to receive longitudinally extending ribs 56 formed in the interior periphery of the casing member 44 so as to limit the movement of the tubular body member 52 within the casing structure 12 to a vertical translational movement.

The tubular body member 52 includes a stepped cylindrically shaped exterior periphery which provides upwardly facing exterior shoulder 58 for engaging an annular fitting 60 mounted in the upper end of the casing member 44 between the seal assembly 16 and the upper end of the spring 22. The engagement of the shoulder 58 with the fitting 60 limits the upward vertical translational movement of the sprinkler body structure 18 and determines the popped-up operative position of the sprinkler head structure 20. At its upper end, the tubular body member 52 necks in and terminates in a cylindrical wall 62. The sprinkler head structure 20 includes a tubular head member 64 also molded of suitable plastic material which includes an exterior cylindrical periphery aligned with the upper portion of the stepped cylindrical periphery of the tubular body member 52 so as to cooperate with the seal assembly 16.

The interior periphery of the tubular body 52 member is also of stepped cylindrical configuration and has a series of ribs or firs 66 extending longitudinally from the central portion thereof up to the necked down upper end of the tubular body member 52. The fins 66 serve to engage the outer periphery of a housing member 68 forming a part of the meshing gear speed reduction assembly 32. The upper portion of the housing member 68 is formed with spaced lugs extending on opposite sides of the fins 66 for purposes of restricting the rotational movement of the housing member 68 within the body member 52. The lower portion of the housing member 68 is formed with spaced lugs which engage beneath the lower ends of the ribs 66 so as to fixedly position the housing member 68 within the tubular body member 52. The housing member 68 is retained in its fixed position by a fixed structure which includes a retaining member 70 in the form of an annular wall having a pair of diametrically opposed arcuate wall portions 72 extending upwardly therefrom. The arcuate portions 72 are configured at their upper ends to engage with the housing member lugs to retain the housing member 68 in its fixed position. The retaining member 70 itself is retained in its operative position by a retaining ring 74. Screen member 24 is mounted within the lower end of the tubular body member 52 below the retaining ring 74 and has an exterior ridge adapted to press fit within an annular groove in the interior surface of the tubular body member 52 adjacent its lower end. It will be noted that the screen member 24 includes a centrally located valve receiving portion 76 around which is engaged an O-ring 78 which serves as a valve element operable to engage a valve seat formed in the inlet 30 of the casing structure 12 when the sprinkler body structure 18 is in its lowermost storage position.

The retaining member 70 includes a bottom wall having a pair of diametrically spaced inlet openings 80 therein and a central bypass opening 82 therebetween. The retaining member 70 includes an annular inlet wall 84 extending upwardly from each inlet opening 80, each of which terminates in an upper end wall having a venturi nozzle 86 formed therein. The central bypass opening 82 is adapted to be controlled by a pressure sensitive bypass valve 88. As shown, the bypass valve 88 includes a tubular stem which is slidably mounted on a cylindrical hub of a mounting member 90 forming a part of the fixed structure. As best shown in FIGS. 2 and 4, the mounting member 90 includes two diametrically opposed portions which are apertured to extend over the nozzles 86 and two depending tubular mounting portions 92, the lower ends of which are shouldered to extend through suitable openings in the bottom wall of the retaining member 70 so as to be fused thereover and thus effect a fixed securement between the retaining member 70 and the mounting member 90. A coil spring 94 is mounted in surrounding relation to the tubular stem of the bypass valve 88 and is engaged with the mounting member 90 so as to resiliently bias the bypass valve 88 into closing relation with the bypass opening 82. The strength of the spring 94 is chosen so that the bypass valve 88 will open at a predetermined overload pressure so as to prevent excessive flow conditions through the nozzles.

The reversible flow-directing mechanism 28 includes a oscillating member 96 molded of plastic material which includes a tubular hub portion 98 snapped into and rotatably mounted within the tubular hub portion of the mounting member 90. The oscillating member 96 extends outwardly from the upper end of the hub portion 98 in a generally circular configuration. As best shown in FIGS. 3 and 4, the oscillating member 96 has formed therein in two diametrically opposed positions a pair of oppositely directed stream-directing surfaces 100 and 102. In addition, a diametrically extending slot 104 is formed in the upper surface oscillatory member 96 which faces upwardly.

The reversing mechanism 40 includes a lever 106 having a hub portion 108 depending therefrom at a position centrally of the ends thereof. The lever 106 has a width which is less than the width of the slot 104 so as to enable the lever 106 to be mounted therein for limited oscillatory movement with respect to the oscillating member 96 and for oscillating movement with the oscillating member 96. As shown, the hub portion 108 is pivoted within the hub portion 98 of the oscillating member 96. As best shown in FIG. 3, the oscillating member 96 is relieved at the positions outwardly of the ends of the slot 104 and the lever 106 includes ends which are provided with oppositely inclined cam surfaces 110. The cam surfaces 110 are adapted to engage V-shaped cam surfaces 112 on a pair of diametrically spaced upright posts 114 formed as an integral part of the mounting member 90. The posts 114 with their V-shaped cam surfaces 112 constitute biased cam members which are disposed in a normal first position wherein one of the cam surfaces of each post is disposed in engagement with a corresponding cam surface 110 on the end of the lever 106. It will be noted that the cantilevered integral connection of the posts 114 enables the same to be resiliently moved from their normal first position in a direction diametrically apart into a second position against the normal bias thereof. Consequently, this normal bias of the posts 114 serves to retain the lever in the position shown in FIG. 3. It will be understood that other biased cam means can be utilized if desired. When in the position shown, one of each pair of flow-directing surfaces 100 are positioned to receive the upwardly directed stream issuing from the associated nozzles 86. As best shown in FIG. 4, the flow directing surfaces 100 serve to direct the streams to the right where they enter into an annular chamber 116 defined by the interior surface of the tubular body member 52 and the arcuate portions 72 of the retaining member 70.

It will also be noted that the deflection of the jet streams issuing from the nozzles 86 by the surfaces 100 creates a reactionary hydraulic force on the oscillating member 96 which tends to rotate the same in a clockwise direction as viewed in FIG. 3. To prevent movement beyond the position shown, the oscillating member 96 is formed with pairs of outwardly diverging abutment walls 118 which engage the upper ends of the nozzles 86. It will be understood that the oscillating member 96 is movable into an opposite limiting position wherein the previously non-engaged cam surfaces 110 on the ends of the lever 106 are disposed in engagement with the previously non-engaged cam surfaces 112 of the posts 114. In this position, the opposite two flow-directing surfaces 102 are positioned to direct the streams issuing from the nozzles 86 to the left as viewed in FIG. 4, with the opposite abutment walls 118 engaging the nozzles 86.

The reversing mechanism 40 also includes an elongated shaft 120 which has its lower end fixed to the central hub portion 108 of the lever 106 with its axis aligned with the axis of rotation of the sprinkler head structure 20 and the oscillatory axis of the oscillating member 96. Rotatably mounted on the shaft 120 within the chamber 118 is the impeller 30 having the usual series of blades onto which the streams issuing from nozzles 86 are directed depending upon which pair of flow-directing surfaces 100 or 102 are in operative relation with the nozzles. When the flow-directing surfaces 100 are in operative position as shown in FIG. 2, the impeller 30 is induced to rotate in a counterclockwise direction, as viewed in FIG. 3. In the opposite position, an opposite rotational movement of the impeller 30 is induced. The impeller 30 includes a hub portion which is rotatably sealably mounted within a central hub portion of a cover 122 which is adapted to engage within the lower end of the housing member 68 of the speed reduction assembly 32.

The hub of the impeller 30 includes an integral sun gear 122 which forms a part of a planetary gear system mounted within the housing member 68. The planetary gear system includes additional sun gears 122 formed as part of planetary gear carriers 124, a plurality of planetary gears 126 which are meshed with the sun gears 122, and orbital gear teeth 128 formed on the interior periphery of the housing member 68. The system also includes a final planetary gear carrier 130 which provides the output member 34 which extends through the neck down apertured upper end of the housing member 68 in rotationally sealed relation with respect thereto.

Figure 6:
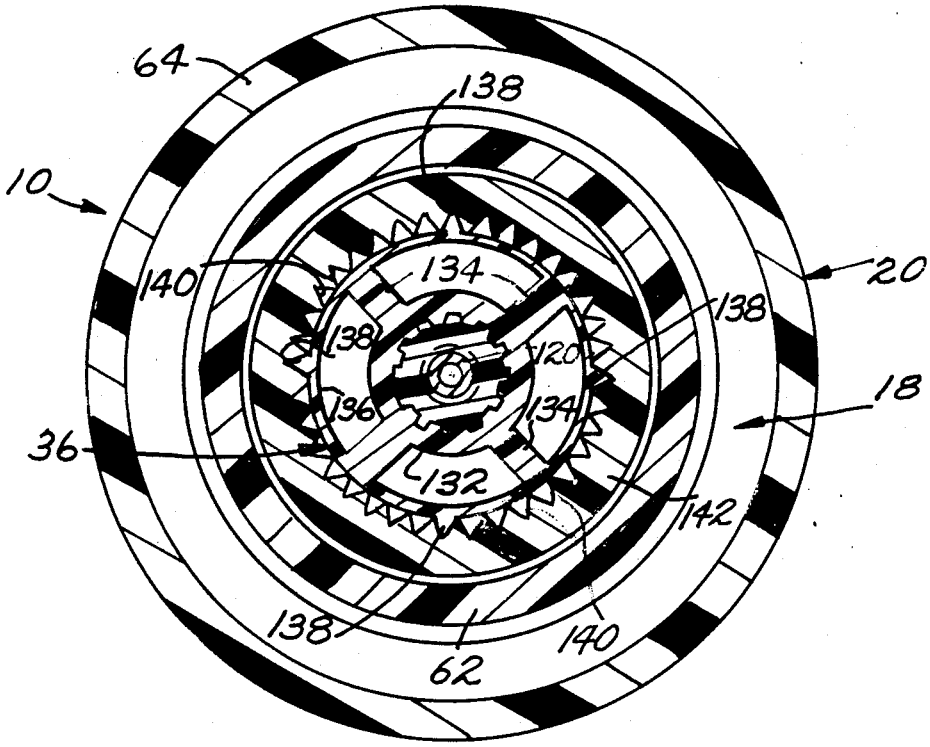
FIG. 6 is an enlarged fragmentary sectional view taken along the line 6—6 of FIG. 2.

As best shown in FIG. 6, the upper end portion of the output member 34 is of hollow configuration and is adapted to receive in snap-fitted relation the slip clutch mechanism 36 which is in the form of a slip clutch member molded of plastic. The slip clutch member 36 includes a hub portion 132 which is internally splined to the exterior of the upwardly protruding tubular end of the output member 34. As shown, the slip clutch member 36 includes a series of annularly spaced ribs 134 extending radially outwardly from the hub portion 132 to a rim portion 136 having four annularly spaced teeth 138 formed on the exterior periphery thereof. As best shown in FIG. 6, the teeth 138 are generally V-shaped in configuration and are provided on the rim portion 136 at positions between the ribs 134 so that they are resiliertly deflectable in a radially inward direction. The teeth 138 are adapted to engage within four spaced longitudinally extending grooves 140 of a series of closely spaced longitudinally extending grooves 140 formed on the inner periphery of a tubular mounting member 142 forming a fixed part of the sprinller head structure 20. As shown, the mounting member 142 has a radially outwardly extending flange 144 at its lower end and an annular seal and washer assembly 146 is disposed between the flange and the adjacent cylindrical portion 62 of the tubular body member 52. The mounting member includes an interior flange against which one end of a coil spring 147 engages, the opposite end of which engages the slip clutch member 36 so as to bias the mounting member 142 upwardly into seal actuating relation with respect to the seal and washer assembly 146.

The tubular head member 64 is formed with integral interior walls 148 which fixedly interconnect, as by ultrasonic welding, with the upper end of the mounting member 142 and lead the flow of water under pressure to the upwardly and outwardly directed outlet within which the outlet orifice member 26 is mounted. As shown, the outlet orifice member 26 is a selected one of a series of different sized orifice members suitably removably mounted within the walls 148. An adjustment bolt 150 is provided for retaining the selected nozzle orifice member 26 in operating position. The lower end of the bolt 150 can be adjusted to serve as a stream diffuser if desired.

The interior walls 148 of the tubular head member 64 also define with the tubular top portion of the head member 64 an interior space 152 opering upwardly into which the shaft 120 extends. As shown, an O-ring seal 122 is provided to effect a seal between the exterior periphery of the shaft 120 and the opening in the interior wall of the head member through which it extends. Fixed to the upper end of the shaft 120 within the space is a fitment 154 which is retained in operative position by snap fitting skirt 156. The part circle pattern control assembly 38 is mounted on the fitment 154 within the space 152 and is capable of adjustment for the purpose of determining the limits at which the reversing mechanism 40 is operated to effect reversal of the reversible flow directing mechanism 28. In order to provide access to the space for purposes of effecting the adjustment of the pattern control assembly 38 while at the same time preventing vandalism as much as possible, the space is closed by the cap structure 42, constructed in accordance with the principles of the present invention.

Figure 7:
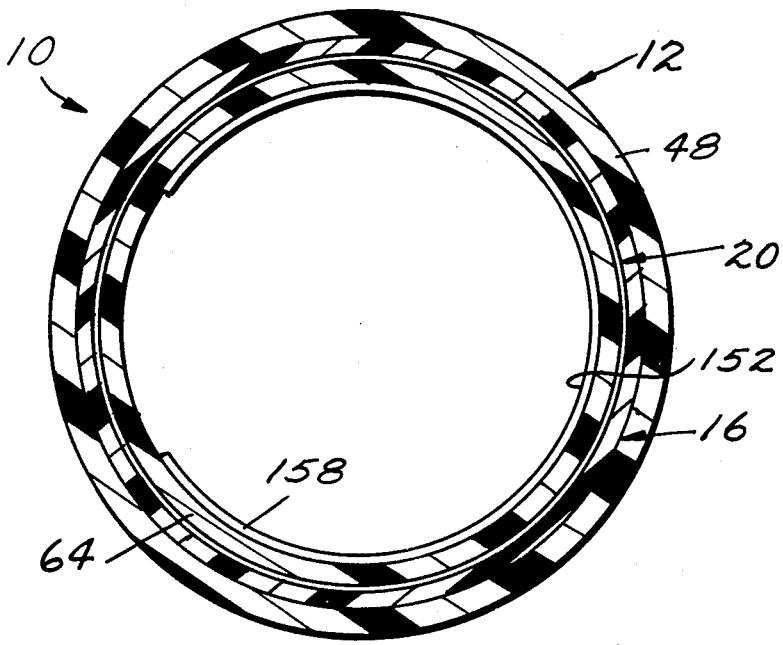
FIG. 7 is a sectional view taken along the line 7—7 of FIG. 2, showing the same with the cap removed.

As best shown in FIG. 7, the tubular top portion of the sprinkler head member 64 has a continuous arcuate lug 158 formed on the interior surface thereof. As shown, the lug extends approximately 305° and is continuous although it may be made somewhat discontinuous so long as there is substantial continuity and there is maintained an arcuate section of the periphery which is devoid of a lug configuration, such as the 55° section which is aligned with the outlet and extends over the inwardly extending interior wall section 160 defining the threads for receiving the bolt 150.

Figure 8:
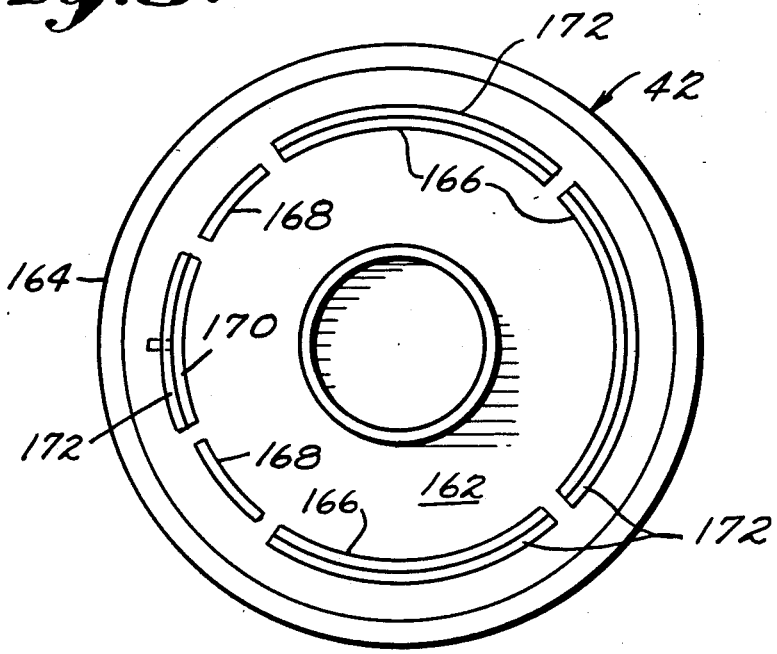
FIG. 8 is a bottom plan view of the removed cap.

The cap structure 42 is of two-piece construction including a disk shaped member 162 molded of plastic material and a cover 164 formed of resilient material which is molded over the exterior periphery of the disk shaped member 162 and covers one surface thereof. Extending from the opposite surface of the disk shaped member 162 is a series of annularly arranged arcuate lugs including three generally similar quadrant shaped lugs 166, two smaller lugs 168, and a central lug 170. The lugs 166 provide exterior arcuate surfaces extending from the disk shaped member which are adapted to engage within the interior of the tubular top portion of the sprinkler head structure 20. The lugs 166 have outwardly extending portions 172 shaped to provide locking surfaces facing toward the disk shaped member 162 for engaging corresponding and opposed locking surfaces on the lug 158. The portions 172 also provide inclined cam surfaces extending from the locking surfaces to the free ends of the lugs for engaging corresponding cam surfaces on the lug 158. As shown in FIG. 8, the central lug 170 also contains portions 172 with the inclined camming surfaces and the locking surfaces. The other two smaller lugs 168 are devoid of the portions 172 which provide the locking surfaces and cam surfaces. The arcuate extent of the central lug is less than the gap in the arcuate lug 158. In the embodiment shown, the central lug 170 has an arcuate extent of approximately 44°.

It can be seen that the removable cap structure 42 can be readily placed in operative position with respect to the tubular top portion of the tubular head member 64 so as to close the space 152 by simply aligning the lugs of the cap member 162 with the interior of the tubular top portion and pushing downwardly. During this movement, the cam surfaces on the portions 172 engage the lug 158 of the top portion and the associated lugs 166 and 170 are cammed radially inwardly until the locking surfaces thereof snap under the locking surfaces provided on the lug 158 of the top portion. In this position, the cap structure 42 is held in closing relation to the opening 152 and the cap structure is capable of being rotated with respect to the head member 64 if manually turned. The cover 164 has molded thereon an indicia 174 which, when oriented with the outlet opening of the sprinkler head structure 20, brings the central lug 170 into the area of the tubular top portion where the interior surface is devoid of lug structure 158. Consequently, by applying an upward prying movement to the edge of the cap structure 42 at a point near the indicia 174, the cap structure 42 is removable, since the wedging action between the remaining locking surfaces is such that they will disengage in response to the prying movement. On the other hand, it will be noted that whenever the locking surface of the central lug 170 is engaged with a locking surface of the lug 158 on the top portion, the cap structure 42 cannot be pried off. Accordingly in order to remove the cap structure 42, it is necessary to align it in the manner previously described.

Figure 9:
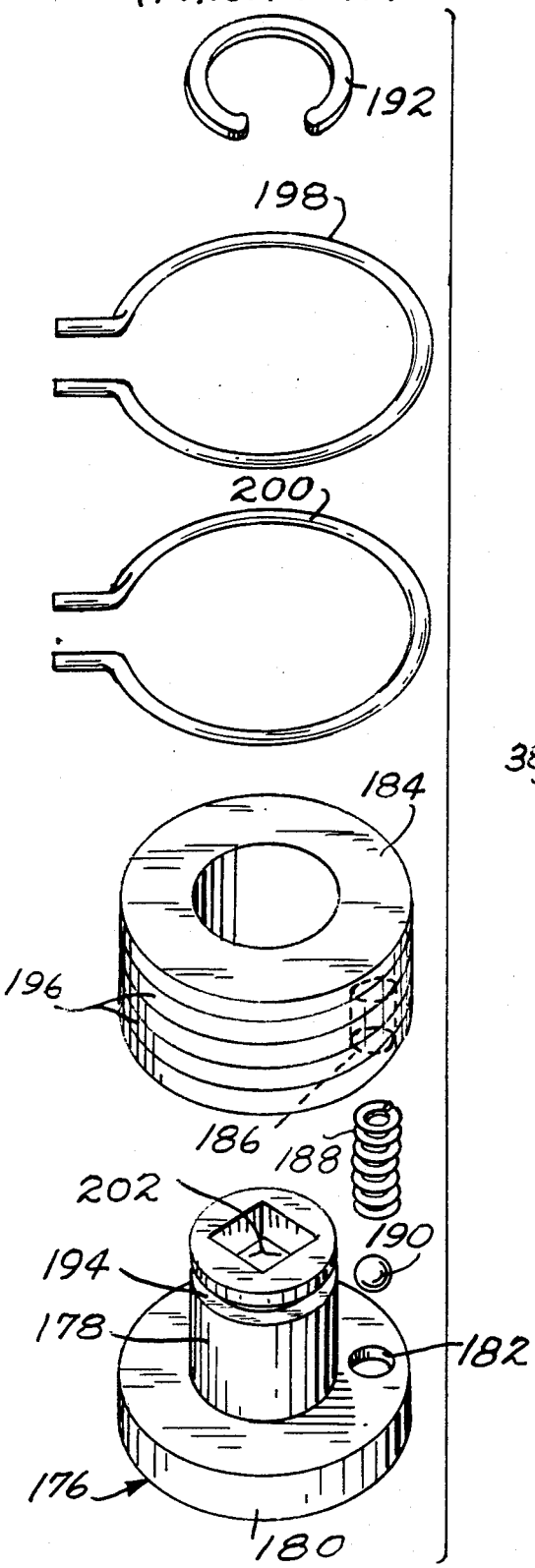
Fig. 9. (PRIOR ART)
FIG. 9 is an exploded perspective view of a prior art pattern control assembly.
Figure 10:
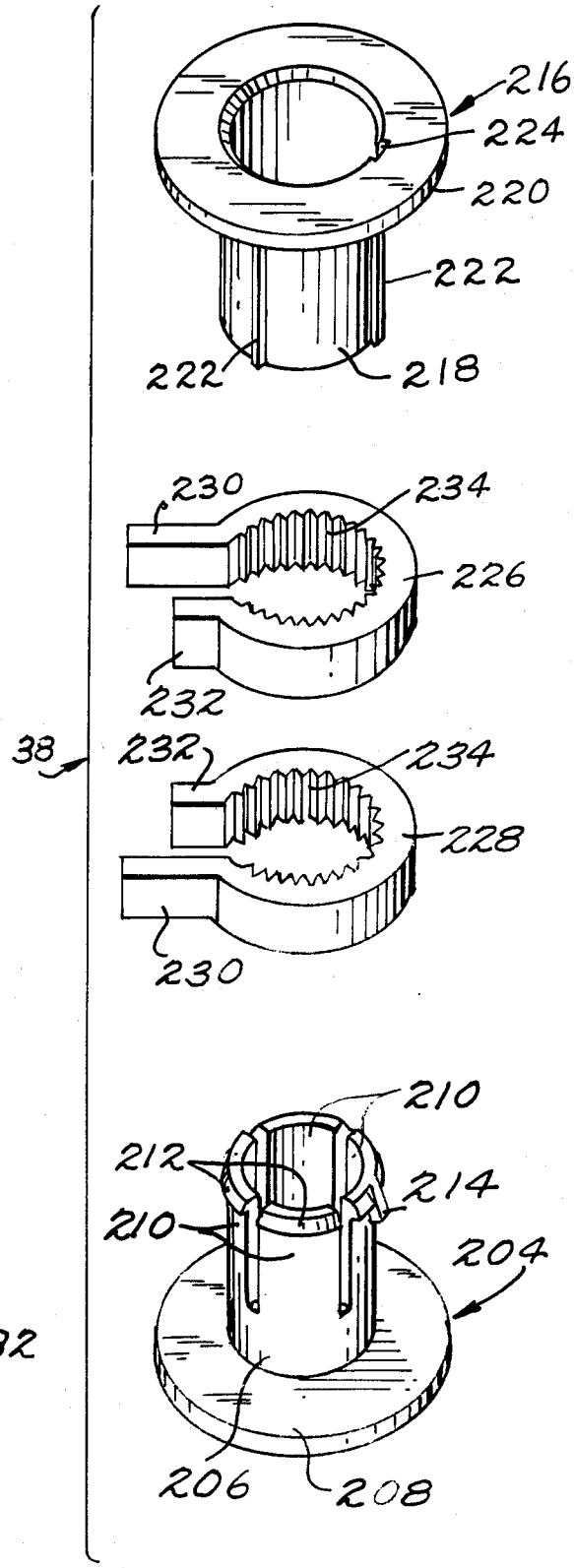
FIG. 10 is a view similar to FIG. 9 of a pattern control assembly embodying the principles of the present invention.

The shaft fitment 154 is of a size and shape similar to a fitment which cooperates with the prior art "memory clutch". The prior art "memory clutch" is shown in FIG. 9 as including an inner member, generally indicated at 176, formed of metal which includes a cylindrical hub portion 178 and a flange portion 180 extending from one end thereof. The flange portion 180 has a cylindrical depression 182 formed in the surface thereof facing in the same direction as the cylindrical hub portion 178. Rotatably mounted on the hub portion 178 is an outer member or sleeve 184 which has an axially extending opening 186 therein which is adapted to receive a coil spring 188 which, in turn, engages a ball 190 of a size to enter the depression 182. A C-clip 192 is adapted to engage within an annular groove 194 in the hub portion 178 so as to retain the outer member 184 on the hub portion 178. In this way, the outer member 184 is retained with the inner member 176 against relative rotation when the ball 190 is spring pressed into engagement with the depression 182, the arrangement permitting an overriding manual movement of the outer member 184 with respect to the inner member 176. The exterior periphery of the outer member 184 is formed with two annular grooves 196 for receiving a pair of arcuately bent metal rods 198 and 200 of an arcuate extent of approximately 320° with their ends 198 and 200 bent radially outwardly. The interior of the hub portion 178 has an opening 202 extending therethrough which is of square cross-section at one end and of round cross-section at its opposite end.

The shaft fitment 154 has its exterior periphery formed with a square cross-section at its lower portion and a round cross-section at its upper portion. When the inner member 176 is mounted with its round cross-sectional area disposed downwardly, the entire memory clutch is simply rotatably carried on the upper end of the fitment 154 and the sprinkler head structure is adapted to operate in a full circle mode. On the other hand, when the memory clutch is reversed so that the square cross-section of the inner member 176 is lowermost, this cross-section keys with the lowermost section of the fitment 154, thus interengaging the inner member with the shaft 120 for movement together. It will be noted that the bent metal rods 198 and 200 by virtue of their inherent resiliency can be manually adjusted so that their outwardly extending ends are disposed at any desirable relative angular position with respect on one another. The position of the outwardly extending ends determines the limits of the segmental part circle pattern at which the "memory clutch" is operated.

While the prior art "memory clutch" may be utilized, it is preferable to utilize a control assembly 38 constructed in accordance with the principles of the present invention. The control assembly 38 includes an inner member, generally indated at 204, which is molded of plastic material and includes a hollow hub portion 206 having an annular flange 208 extending radially outwardly from one end thereof. The opposite end of the hub portion 206 is slotted at annularly spaced positions so as to form integral spring fingers 210 in the outer section of the hub portion 206. Spring fingers 210 have attaching lugs 212 extending outwardly therefrom shaped to provide cam surfaces and locking surfaces similar to the lugs of the cap member 162. One of the spring fingers 210 includes a projection 214 on the exterior thereof at the level of the lug 212.

The pattern control assembly 38 also includes an outer member, generally indicated at 216, which includes a tubular hub portion 218 having an annular flange 220 extending radially outwardly from one end thereof. The hub portion 218 includes an inner peripheral surface of a size to engage the exterior peripheral surface of the hub portion 2–4 of the inner member and an exterior surface formed with a series of annularly spaced V-shaped ridges 222 extending axially therealong. In addition, the interior surface of the hub portion adjacent the flange is formed with a recess 224.

The pattern control assembly 38 also includes a pair of arcuate adjustable members 226 and 228 formed of plastic material. These members include one long end portion 230 extending radially therefrom and a short end portion 232. The interior surface of the adjustable members 226 and 228 are formed with serrations 234 which cooperate with the ridges 222 on the exterior surface of the outer member 216.

The components of the pattern control assembly 38 are assembled by engaging the two adjustment members 226 and 228 on the exterior periphery of the outer member 216 and then effecting a relative axial movement between the inner and outer members from separate positions into cooperating positions during which the interior periphery of the outer member 216 engages the lugs 212 and deflects the spring fingers 210 radially inwardly until the lugs 212 reach the end of the hub portion 218 of the outer member 216 and spring outwardly so as to retain the assembly together. The hollow hub portion 206 of the inner member 204 is of square cross-sectional configuration at the flange end. The control assembly 38 is therefore reversible to provide full circle operation in addition to its normal operative part circle pattern determining position when keyed on the fitment 154 as shown in FIG. 2.

It will be noted that in one position of relative rotational movement between the outer member 216 and the inner member 204, the projection 214 engages within the recess 224. The arrangement is therefore one which is operable to be (1) engageable to transmit operative sprinkler head causing annular movements of the outer member 216 in either direction to corresponding movements of the inner member 204 and (2) yieldably disengageable in response to manually caused overriding annular movements of the outer member 216 in either direction so as to enable the outer member 216 to be manually moved relative to the inner member 204.

OPERATION

FIG. 1 illustrates the sprinkler assembly 10 in an installed popped-up operating position. In this position, the inlet section of the casing member 44 is threaded on an in-ground pipe P. When the water under pressure is turned off from the pipe P, the sprinkler assembly 10 assumes its lowered storage position, as shown in FIG. 2, by virtue of the bias of spring 22. When the water is turned on and water under pressure is available from the pipe P, the water initially acts on the O-ring seal 78 and the structure 76 retaining the same to move the sprinkler body structure 18 and sprinkler head structure 20 upwardly. As the O-ring seal 78 moves off of the seat inlet opening 14, water enters the interior of the casing structure 12 and communicates through the screen member 24 to the interior of the sprinkler body structure 18. By virtue of the seal provided by the annular seal assembly 16, water under pressure within the casing structure 12 acting on the sprinkler body structure 18 serves to move the same into its popped-up operative position as shown in FIG. 1.

In this position, the seal assembly 16 prevents flow of water under pressure between the tubular body member 52 and the casing structure 12. The water low path within the sprinkler body structure is first through the screen member 24 and then into the inlet openings 80 and through the nozzle orifices 86. When a nozzle member 26 having a relatively small outlet orifice is utilized, the bypass valve 88 generally will remain in closed relation with the bypass opening 82. The bypass valve 88 will open when the orifice size is near the upper limit of the range provided. If it is assumed that the reversible flow directing mechanism 28 is in the position shown in FIG. 4, the impeller 30 will be induced by the direction of the flow within the chamber 118 to rotate in a counterclockwise direction as viewed from above. This rotational movement of the impeller 30 is transmitted through the planetary gear reduction assembly 32 to a rotational movement of the output member 34 in a corresponding direction but at a significantly lesser speed. The rotational movement of the output member 34 is then transmitted to the sprinkler head structure 20 through the slip clutch mechanism 36. The flow path of the water is thus through the inlet openings 80, then through the nozzles 86 into the chamber 118 and upwardly along the exterior of the housing member 58 past the fins 66 and then upwardly into the mounting member 142 of the sprinkler head structure 20 and through the slip clutch member 36 therein and finally upwardly into the sprinkler head structure 20 and out the orifice of the outlet member 26 so as to be directed into the atmosphere as an upwardly and outwardly projecting stream.

The slow rotational movement imparted to the sprinkler head structure 20 by the rotation of the impeller 30 and the operation of the speed reduction assembly 32 serves to move the discharging stream in a corresponding counterclockwise direction as viewed from above. As the sprinkler head structure 20 continues to move, the inner wall portion 160 within the sprinkler head space 152 will move into engagement with a long end portion 230 of one of the adjusting members 226 or 228 depending upon the setting which is made. In FIG. 7, the setting is for a quarter circle, such as might be employed in a corner sprinkler assembly 10 of a system. When the wall portion 160 engages the adjustable member 226 the movement is transmitted through the serrated edges 234 and the ridges 222 to the outer member 216 of the pattern control assembly 38 which, in turn, by virtue of the engagement of the projection 214 within the recess 224 is transmitted to the inner member 204. Since the inner member is keyed to the fitment 154 on the shaft 120, shaft 120 is turned which has the effect of turning the lever 106 of the reversing mechanism 40.

As can best be seen in FIG. 3, the initial movement of the lever 106 results in an initial movement of the oscillating member 96 of the reversible flow directing mechanism 28. During this initial movement of the lever 106, the cam posts 114 are moved from their first positions radially outwardly into their second positions against their natural bias. When the engaged cam surfaces 110 and 112 on the ends of the lever and the posts disengage the resilient bias of the posts 114 tend to move the same back into their first positions, so as to interengage the cam surfaces 110 and 112 which heretofore have not been engaged. This interengagement causes the lever 106 to rapidly advance the oscillating member 96 thus bringing flow directing surfaces 102 into the jet streams issuing from the nozzles 86. As soon as the surfaces 102 are engaged to an extent greater than the surfaces 100 which previously have been in full engagement, the hydraulic forces tend to move the oscillating member 96 fully into its opposite limiting position.

In the reversed position, the flow within the chamber 118 is now clockwise as viewed from above resulting in a clockwise movement of the impeller 30 which, in turn, reverses the direction of the movement of the sprinkler head structure 20 to a clockwise movement as viewed from above. Thus, the stream discharging from the orifice of the outlet member 26 is now directed within one limit of the segmental pattern set and is moved in the clockwise direction with the movement of the sprinkler head structure 20. It will be noted that the adjusting members 226 and 228 are readily adjusted by moving the big end portion 230 in an annular direction opposite to that which it would be engaged by the movement of the head structure 20. The arrangement is such that movement in one direction tends to lock in the serrations 234 on the ridges 222 while movement in the opposite direction tends to separate them and allow them to move by.

It will be understood that the characteristic of a planetary gear system of the type utilized which achieves a substantial reduction in speed is such that it is not possible to feed back the movement in a direction opposite from the drive direction. In other words, if the sprinkler head structure 20 were keyed directly to the output member 34, then the sprinkler head structure 20 could not be moved manually without injuring the speed reduction unit or other instrumentality. By providing the slip clutch mechanism 36, an unwanted manual movement applied to the sprinkler head structure 20 merely results in the independent turning of the sprinkler head structure 20 with respect to the sprinkler body structure 18. The slip clutch member simply operates so that the teeth 138 are moved successively along the grooves 140 in the mounting member 142. On the other hand, such an unwanted manual turning movement of the sprinkler head structure 20 will have the affect of engaging the interior wall portion 160 of the sprinkler head structure with one or the other of the adjusting members 226 or 228 depending upon which direction the manual movement is in. When this interengagement takes place, the interengagement of the serrations 234 of the adjusting member with the ridges 222 is retained and the outer member 216 is therefore turned with the head structure 20 but this movement is not transmitted to the inner member 204, but rather the projection 214 on the finger portion 210 of the inner member 204 merely rides out of the recess 224. If it is assumed that the unwanted manual movement is ended with the sprinkler head structure 20 at a position out of its normal operating limits when the operation is commenced, the sprinkler head structure will simply be moved in the direction in which the reversing flow directing mechanism 28 is set. This movement will continue until the wall portion 160 moves the adjusting member and hence the outer member 216 relative to the inner member 204 into a position in which the projection 214 enters the recess 224. In this position, the continued movement of the head structure 20 will now effect a movement of the inner member 214 which, as previously described, will effect a reversing movement of the flow directing mechanism 28, thus automatically returning the sprinkler head structure 20 for operation between the previously set limits.

It thus will be seen that the objects of this invention have been fully and effectively accomplished. It will be realized, however, that the foregoing preferred specific embodiments tave been shown and described for the purpose of illustrating the functional and structural principles of this invention and are subject to change without departure from such principles. Therefore, this invention includes all modifications encompassed within the spirit and scope of the following claims.

What is claimed is:

1. An adjustable part circle sprinkler assembly comprising a sprinkler body structure having inlet means for communication with a source of water under pressure, a sprinkler head structure mounted on said sprinkler body structure for rotational movement about an upright axis either in one direction or an opposite direction, means defining a sealed flow path for water under pressure communicated with said inlet means including outlet means in said sprinkler head structure for discharging the water in an upwardly and outwardly extending stream formation so as to be dispersed in an instantaneous generally segmental ground pattern within a circular ground pattern, said flow path defining means including means defining an annular chamber and reversible flow directing means mounted in said sprinkler body structure for movement between (1) a first position for directing water in said flow path into said chamber in one annular direction and (2) a second position for directing water in said flow path into said chamber in an opposite annular direction, an impeller mounted in said chamber for rotation by the flow of water in said chamber in a direction corresponding to the annular direction of movement of the water into said chamber, a meshing gear speed reduction assembly drivingly connected with said impeller and including a rotary output member rotatable in a direction commensurate with the direction of rotation of said impeller and at a speed commensurately less than the speed of rotation of said impeller, the operation being such that said output member cannot be rotationally moved when said impeller is stationarily inoperable, slip clutch means operatively connecting said rotary output member with said sprinkler had structure for (1) normally operable rotational movement commensurate with the rotational movement of said rotary output member and (2) manual rotational movement in either direction without a commensurate movement of said rotary output member, part circle pattern control means operatively connected with said reversible flow directing means and said sprinkler head structure including first means for adjustably predetermining the limits of the part of the circular ground pattern within which the instantaneous generally segmental ground pattern of the water is moved in opposite directions by corresponding opposite movements of the sprinkler head structure through positions within such limits and second means operable when said sprinkler head structure is manually moved as permitted by said slip clutch means into a position beyond the predetermined limits for enabling the sprinkler head structure to be moved in response to the rotational movement of said impeller back within said limits for continued normal movements in opposite directions within said limits.

2. An adjustable part circle sprinkler assembly as defined in claim 1 wherein said part circle pattern control means includes a reversing mechanism comprising:

lever means mounted for oscillating movement through successive operating cycles each of which includes a first operative stroke in one direction and a second operative stroke in the opposite direction, said lever means being movable (1) through an initial portion of said first operative stroke in response the movement of said sprinkler head structure through a corresponding movement into one of its predetermined limits and (2) through an initial portion of said second operative stroke in response to the movement of said sprinkler head structure through a corresponding movement into the other of its predetermined limits, cam means mounted for biased movement from a second position into a first position and for movement against such bias from said first position into said second position, said lever means having cam surface means thereon for effecting (1) movement of said cam means from said first position into said second position against the bias thereof in response to the movement of said lever means through said initial portion of said first operative stroke so that the subsequent biased movement of said cam means from said second position into said first position moves said lever means rapidly through a final portion of the first operative stroke thereof and (2) movement of said cam means from said first position into said second position against the bias thereof in response to the movement of said lever means through said initial portion of said second operative stroke so that the subsequent biased movement of said cam means from said second position into said first position moves said lever means rapidly through a final portion of the second operative stroke thereof and means for effecting reversing movements of said reversible flow directing means between the first and second positions thereof in response to the rapid movements of said lever means through the final portions of the first and second strokes thereof.

3. An adjustable part circle sprinkler assembly as defined in claim 2 wherein said lever means comprises an elongated lever, said lever having a shaft fixed to the central portion thereof and extending upwardly therefrom, said sprinkler head structure having a tubular top portion defining an interior space opening upwardly into which said shaft extends, said first and second means belong disposed in said tubular top portion interior space with said inner member connected to the upper end of said shaft, a cap structure and means mounting said cap structure for (1) engagement with said tubular top portion to close the upwardly opening interior space defined thereby and (2) disengagement from said tubular top portion to permit manual access to said first and second means within the upwardly opening interior space defined thereby.

4. An adjustable part circle sprinkler assembly defined in claim 3, wherein said flow path defining means includes a fixed structure having spaced upwardly extending nozzles for directing the water in the flow path into a plurality of upwardly projecting jet streams, said reversible flow directing means including an oscillating member pivotally mounted on said fixed structure for oscillating movement between said first and second positions, said oscillating member having a plurality of pairs of oppositely directed jet stream receiving and directing surfaces, each pair of jet stream receiving and directing surfaces being adjacent one another and being symmetrical with respect to a plane passing through the pivotal axis of said oscillating member.

5. An adjustable part circle sprinker assembly as defined in claim 4 wherein said fixed structure is of molded plastic construction, said cam means comprising a pair of diametrically opposed upright posts having V-shaped cam surfaces on the portions thereof facing one another, the bias of said cam means being provided by the resiliency of the plast material forming said posts, the cam surface means on said lever means comprising V-shaped cam surfaces on the ends of said lever.

6. An adjustable part circle sprinkler assembly defined in claim 5 wherein said means for effecting reversing movements of said reversible flow directing means comprises interengaging surfaces on said lever and said oscillating member, the interengaging surfaces on said oscillating member being provided on parallel opposed side walls defining an upwardly opening slot in the upper portion of said oscillating member, the interengaging surfaces on said lever being provided on oppositely facing parallel sides thereof, said lever being disposed within said slot with the interengaging surfaces thereof spaced from the interengaging surfaces of said oscillating member when said lever is in a mid position with respect to said oscillating member.

7. An adjustable part circle sprinkler assembly as defined in claim 6 wherein said cap structure mounting means comprises interengaging lug means on said cap structure and said sprinkler head structure for (1) enabling said cap structure to be engaged with the tubular top portion of said sprinkler head structure in closing relation with respect to the upwardly opening interior space thereof in such a way that said cap structure is generally unrestrictively rotatable in either direction so as to permit unwanted manual rotation thereof without a commensurate rotational movement of said sprinkler head structure and (2) enabling said cap structure to be disengaged from the tubular top portion of said sprinkler head structure to expose the upwardly opening interior space thereof by a manual prying action only when said cap structure is within a limited range of annular positions with respect to said sprinkler head structure.

8. An adjustable part circle sprinkler assembly as defined in claim 7 wherein said part circle pattern control means includes a pattern control assembly comprising an outer annular member having annular exterior peripheral surface means and annular interior peripheral surface means, an inner member having means for mounting the same for annular movement in one direction and in an opposite direction in cooperating relation with said lever means so that (1) a predetermined annular movement of said inner member in one direction is operable to effect a movement of said lever means through said initial portion of said first stroke to thereby reverse the movement of said sprinkler head structure and the instantaneous generally segmental ground pattern of the discharged water from one direction to an opposite direction and (2) a predetermined annular movement of said inner member in an opposite direction is operable to effect a movement of said lever means through said initial portion of said second stroke to reverse the movement said sprinkler head structure and the instantaneous generally segmental ground pattern of the discharged water from said opposite direction to said one direction, said inner member having annularly arranged resiliently yieldable finger means operable in response to a relative axial movement between said inner and outer member from separate positions into cooperating positions to cooperate with the interior peripheral surface means of said outer member to retain said members in their cooperating positions, said first means comprising first and adjustable members mounted on the exterior peripheral surface means of said outer member for (1) selective annular movement with respect to said outer member by manual adjustment into any selected one of a multiplicity of different part circle pattern defining positions and (2) annular motion transmitting relation with respect to said outer member so that (A) movement of the sprinkler head structure in said one direction into said first member transmits a corresponding annular movement to member in one direction and (B) movement of the sprinkler head structure in said opposite direction into said second member transmits a corresponding annular movement to said outer member in an opposite direction and said second means comprising interengaging surface means between said resiliently yieldable finger means and said interior peripheral surface means operable to be (1) engageable to transmit operative sprinkler head structure causing annular movements of said outer member in either direction to corresponding movements of said inner member and (2) yieldably disengageable in response to manually caused overriding annular movements of said outer member in either direction so as to enable said outer member to be manually moved relative to said inner member.

9. An adjustable part circle sprinkler assembly as defined in claim 8 wherein said sprinkler body and head structures are mounted within a tubular casing for rectilinear movement lowered storage position and a popped up operative position, said casing having a lower end provided with said inlet for connection with a pipe having water under pressure therein and an open upper end through which said sprinkler body and head structures extend when in said popped up operative position, return sprinq means between said tubular casing and said sprinkler body structure for resiliently biasing the latter into its lowered storage position, and annular seal means within the open upper end of said casing cooperating with the exterior peripheries of said sprinkler body and head structures so that the introduction of water under pressure through said casing inlet causes said sprinkler body and head structures to move from their lowered storage position into their popped up operative position against the action of said return spring means.

10. An adjustable part circle sprinkler assembly as defined in claim 9 wherein said sprinkler body structure includes a lower annular seal operable to close the inlet of said casing from the inlet means of said sprinkler body structure when said sprinkler body is in its lowered storage position, said lower annular seal enabling the water under pressure introduced into said inlet to enter said inlet means when said sprinkler body structure is moved away from its lowered storage position.

11. An adjustable part circle sprinkler assembly as defined in claim 10 wherein said flow path defining means includes normally closed bypass pressure relief valve means in parallel with said plurality of nozzles openable in response to a predetermined excess inlet pressure to allow water to bypass said nozzles in said flow path.

12. An adjustable part circle sprinkler assembly defined in claim 1 wherein said part circle pattern control means includes a pattern control assembly comprising an outer annular member having annular exterior peripheral surface means and annular interior peripheral surface means, a inner member having means for mounting the same for annular movement in one direction and in an opposite direction in cooperating relation with reversible flow directing means so that (1) a predetermined annular movement of said inner member in one direction is operable to effect a movement of said reversible flow directing means to thereby reverse the movement of said sprinkler head structure and the instantaneous generally segmental ground pattern of the discharged water from one direction to an opposite direction and (2) a predetermined annular movement of said inner member in an opposite direction is operable to effect a movement of said reversible flow directing means to reverse the movement of said sprinkler head structure and the instantaneous generally segmental ground pattern of the discharged water from said opposite direction to said one direction, said inner member having annularly arranged resiliently yieldable finger means operable in response to a relative axial movement between said inner and outer member from separate positions into cooperating positions to cooperate with the interior peripheral surface means of said outer member to retain said members in their cooperating positions, said first means comprising first and second adjustable members mounted on the exterior peripheral surface means of said outer member for (1) selective annular movement with respect to said outer member by manual adjustment into any selected one of a multiplicity of different part circle pattern defining positions and (2) annular motion transmitting relation with respect to said outer member so that (A) movement of the sprinkler head structure in said one direction into said first member transmits a corresponding annular movement to said outer member in one direction and (B) movement of the sprinkler head structure in said opposite direction into said second member transmits a corresponding annular movement to said outer member in an opposite direction and said second means comprising interengaging surface means between said spring finger means and said interior peripheral surface means operable to be (1) engageable to transmit operative sprinkle head structure causing annular movements of said outer member in either direction to corresponding movements of said inner member and (2) yieldably disengageable in response to manually caused overriding annular movements of said outer member in either direction so as to enable said outer member to be manually moved relative to said inner member.

13. An ajustable part circle sprinkler assembly as defined in claim 12 wherein said sprinkler head structure includes a tubular top portion defining an interior space opening upwardly, said first and second means being disposed in said tubular top portion interior space, a cap structure and means mounting said cap structure for (1) engagement with said tubular top portion to close the upwardly opening interior space defined thereby and (2) disengagement from said tubular top portion to permit manual access to said first and second means within the upwardly opening interior space defined thereby, said cap structure mounting means comprises interengaging lug means on said cap structure and said sprinkler head structure for (1) enabling said cap structure to be engaged with the tubular top portion of said sprinkler head structure in closin relation with respect to the upwardly opening interior space thereof in such a way that said cap structure is generally unrestrictively rotatable in either direction so as to permit unwanted manual rotation thereof without a commensurate rotational movement of said sprinkler head structure and (2) enabling said cap structure to be disengaged from the tubular top portion of said sprinkler head structure to expose the upwardly opening interior space thereof by a manual prying action only when said cap structure is within a limited range of annular positions with respect to said sprinkler head structure.

14. adjustable part circle sprinkler assembly as defined in claim 1 wherein said sprinkler head structure includes a tubular top portion defining an interior space opening upwardly, said first and second means being disposed in said tubular top portion interior space, a cap structure and means mounting said cap structure for (1) engagement with said tubular top portion to close the upwardly opening interior space defined thereby and (2) disengagement from said tubular top portion to permit manual access to said first and second means within in the upwardly opening interior space defined thereby, said cap structure mounting means comprises interengaging lug means on said cap structure and said sprinkler head structure for (1) enabling said cap structure to be engaged with the tubular top portion of said sprinkler head structure in closing relation with respect to the upwardly opening interior space thereof in such a way that said cap structure is generally unrestrictively rotatable in either direction so as to permit unwanted manual rotation thereof without a commensurate rotational movement of said sprinkler head structure and (2) enabling said cap structure to be disengaged from the tubular top portion of said sprinkler head structure to expose the upwardly opening interior space thereof by a manual prying action only when said cap structure is within a limited range of annular positions with respect to said sprinkler head structure.

15. An adjustable part circle sprinkler assembly as defined in claim 1 wherein said sprinkler body and head structures are mounted within a tubular casing for rectilinear movement between a lowered storage position and a popped up operative position, said casing having a lower end with an inlet for connection with a pipe provided with an inlet for connection with a pipe having water under pressure therein and an open upper end through which said sprinkler body and head structures extend when in said popped up operative position, return spring means between said tubular casing and said sprinkler body structure for resiliently biasing the latter into its lowered storage position, and annular seal means within the open upper end of said casing cooperating with the exterior peripheries of said sprinkler body and head structures sot hat the introduction of water under pressure through said casing inlet causes said sprinkler body and head structures to move from their low red storage position into their popped up operative position against the action of said return spring means.

16. adjustable part circle sprinkler assembly as defined in claim 15 wherein said sprinkler body structure includes a lower annular seal operable to close the inlet of said casing from the inlet means of said sprinkler body structure when said sprinkler body is in its lowered storage position, said lower annular seal enabling the water under pressure introduced into said inlet to enter said inlet means when said sprinkler body structure is moved away from its lowered storage position.

17. An adjustable part circle sprinkler assembly as defined in claim 16 wherein said flow path defining means includes normally closed bypass pressure relief valve means in parallel with said plurality of nozzles openable in response to a pressure predetermined excess inlet pressure to allow water to bypass said nozzles in said flow path.

18. An adjustable part circle sprinkler assembly comprising a sprinkler body structure having inlet means for communication with a source of water under pressure, sprinkler head structure mounted on said sprinkler body structure for rotational movement about an upright axis either in one direction or an opposite direction, means defining a sealed flow path for water under pressure communicated with said inlet means including outlet means in said sprinkler head structure for discharging the water in an upwardly and outwardly extending stream formation so as to be dispersed in an instantaneous generally segmental ground pattern within a circular ground pattern, said flow path defining means including means defining an annular chamber and reversible flow directing means mounted in said sprinkler body structure for movement between (1) a first position for directing water in said flow path into said chamber in one annular direction and (2) a second position for directing water in said flow path into said chamber in an opposite annular direction, means operatively associated with the flow of water in said chamber and with said sprinkler head structure for effecting rotational movements of said sprinkler head structure in opposite directions depending upon which of the opposite directions the water is directed into the chamber, and reversing means for (1) moving said flow directing means from said first position into said second position when said sprinkler head reaches a first predetermined limiting position and (2) moving said flow directing means from said second position into said first position when said sprinkler head reaches a second predetermined limiting position said reversing means comprising:

lever means mounted for oscillating movement through successive operating cycles each of which includes a first operative stroke in one direction and a second operative stroke in the opposite direction, means for moving said lever means (1) through an initial portion of said first operative stroke in response to the movement of said sprinkler head structure through a corresponding movement into first its predetermined limiting position and (2) through an initial portion of said second operative stroke in response to the movement of said sprinkler head structure through a corresponding movement into its second predetermined limiting position, cam means mounted for biased movement from a second position into a first position and for movement against such bias from said first position into said second position, said lever means having cam surface means thereon for effecting (1) movement of said cam means from said first position into said second position against the bias thereof in response to the movement of said lever means through said initial portion of said first operative stroke so that the subsequent biased movement of said cam means from said second position into said first position moves said lever means rapidly through a final portion of the first operative stroke thereof and (2) movement of said cam means from said first position into said second position against the bias thereof in response to the movement of said lever means through said initial portion of said second operative stroke so that the subsequent biased movement of said cam means from said second position into said first position moves said lever means rapidly through a final portion of the second operative stroke thereof and means for effecting reversing movement of said reversible flow directing means between the first and second positions thereof in response to the rapid movements of said lever means through the final portions of the first and second strokes thereof.

19. An adjustable part circle sprinkler assembly as defined in claim 18 wherein said lever means comprises an elongated lever, said lever having a shaft fixed to the central portion thereof and extending upwardly therefrom, said sprinkler head structure having a tubular top portion defining an interior space opening upwardly into which said shaft extends, and an adjustable pattern control assembly in said tubular top portion interior space connected to the upper end of said shaft, a cap structure and means mounting said cap structure for (1) engagement with said tubular top portion to close the upwardly opening interior space defined thereby and (2) disengagement from said tubular top portion to permit manual access to said adjustable pattern control assembly within the upwardly opening interior space defined thereby.

20. An adjustable part circle sprinkler assembly as defined in claim 19 wherein said flow path defining means includes a fixed structure having spaced upwardly extending nozzles for directing the water in the flow path into a plurality of upwardly projecting jet streams, said reversible flow directing means including an oscillation member pivotally mounted on said fixed structure for oscillating movement between said first and second positions, said oscillating member having a plurality of pairs of oppositely directed jet stream receiving and directing surfaces, each pair of jet stream receiving and directing surfaces being adjacent on another and being symmetrical with respect to a plane passing through the pivotal axis of said oscillating member.

21. An adjustable part circle sprinkler assembly as defined in claim 21 wherein said fixed structure is of molded plastic construction, said cam means comprising a pair of diametrically oppressed upright posts having V-shaped cam surfaces on the portions thereof facing one another, the bias of said cam means being provided by the resiliency of the plastic material forming said posts, the cam surface means on said lever means comprising V-shaped cam surfaces on the ends of said lever.

22. An adjustable part circle sprinkler assembly as defined in claim 21 wherein said means for effecting reversing movements of said reversible flow direction means comprises interengaging surfaces said lever and said oscillating member, the interengaging surfaces on said oscillating member being provided on parallel opposed side walls defining an upwardly opening slot in the upper portion of said oscillating member, the interengaging surfaces on said lever being provided on oppositely facing parallel sides thereof, said lever being disposed within said slot with the interengaging surfaces thereof spaced from the interengaging surfaces of said oscillating member when said ever is in a mid position with respect to said oscillating member.

23. A pattern control assembly for an adjustable part circle sprinkler assembly including sprinkler body means having inlet means for communication of water under pressure therewith, sprinkler ead means mounted on said sprinkler body means for rotational movement about an upright axis having outlet means for directing water communicated with said inlet means in an upwardly and outwardly extending stream formation so as to be dispersed in an instaneous generally segmental ground pattern within a circular ground pattern, and reversible drive means operable by the water flowing through said sprinkler body means and said sprinkler head means between said inlet means and said outlet means for moving said sprinkler head means about said upright axis in either direction, said pattern control assembly being operable o cooperate with the reversible drive means to determine the direction and extent of movement of the sprinkler head means to thereby determine the direction and extent the instantaneous generally segmental ground pattern of the dispersed water is moved within said circular pattern, said pattern control assembly further being operable After the sprinkler head means has been manually moved beyond either determined extent of movement to automatically return the sprinkler head means within the determined extents of movement during subsequent operation, said pattern control assembly comprising an outer annular member having annular exterior eripheral surface means and annular interior surface means, an inner member having means for mounting the same for annular movement in one direction and in an opposite direction in cooperating relation with the reversible drive means of the sprinkler assembly so that (1) a predetermined annular movement of said inner member in one direction is operable to effect a reversal of said reversible drive means so as to reverse the movement of the sprinkler head means of the sprinkler assembly and the instaneaneous generally segmental ground pattern of the discharged water from one direction to an opposite direction and (2) a predetermined annular movement of said inner member in an opposite direction is operable to effect a reversal of said reversible-drive means to reverse the movement of the sprinkler head means of the sprinkler assembly and the instantaneous generally segmental ground pattern o the discharged water from said opposite direction to said one direction, said inner member having annularly arranged resiliently yieldable finger means operable in response to a relative axial movement between said inner and outer members from separate positions into cooperating positions to cooperate with the interior peripheral surface means of said outer member to retain said members in their cooperating positions, first and second adjustable members mounted on the exterior peripheral surface means of said outer member for (1) selective annular movement with respect to said outer member by manual adjustment into any selected one of a multiplicity of different part circle pattern defining positions and (2) annular motion transmitting relation with respect to said outer member so that (A) movement of the sprinkler head meanings said one direction into said first member transmits a corresponding annular movement to said outer member in one direction and (B) movement of the sprinkler head means in said opposite direction into said second member transmits a corresponding annular movement to said outer member in opposite direction and interengaging surface means between said resiliently yielding finger means and said interior peripheral surface means operable to be (1) engageable to transmit operative sprinkler head means causing annular movements of said outer member in either direction to corresponding movements of said inner member and (2) yieldably disengageable in response to manually caused overriding annular movements of said outer member in either direction so as to enable said outer member to be manually moved relative to said inner member.

24. A pattern control assembly as defined in claim 23 wherein said inner and outer members and said first and second adjustable members are molded of plastic material.

25. A pattern control assembly as defined in claim 24 wherein each of said adjustable members is of elongated configuration having a central arcuate portion of substantial arcuate extent, a relatively long end portion extending radially outwardly from one end of said central arcuate portion and a relatively short end portion extending radially outwardly from the opposite end of said central arcuate portion, said central arcuate portion having serrated surface means on the interior periphery thereof, the annular exterior peripheral surface means of said outer member having axially extending ridge means thereon for engaging the serrated surface means of each adjustable member so that the force required to effect said selective annular movement by manual adjustment of the long end portion of each adjustable member is substantially greater in a direction toward the associated sort end portion than in a direction away from the associated short end portion, said first and second adjustable members being arranged on the exterior peripheral surface means of said outer member with the long end portions positioned correspondingly with the arcuate extent of the predetermined part circle pattern and the short end portions disposed therebeyond.

26. A pattern control assembly as defined in claim 25 wherein said interengaging surface means is provided by a single groove in said interior peripheral surface means and a single groove entering projection on said spring finger means.

27. In an adjustable part circle sprinkler assembly including sprinkler body means having inlet means for communication of water under pressure therewith sprinkler head means mounted on said sprinkler body means for rotational movement about an upright axis having outlet means for directing water communicated with said inlet means in an upwardly and outwardly extending stream formation so as to be dispersed in an instantaneous segmental ground pattern within a circular ground pattern, reversible drive means operable by the water flowing through said sprinkler body means and said sprinkler head means between said inlet means and said outlet means for moving said sprinkler head means about said upright axis in either direction, and a pattern control assembly cooperable with said reversible drive mean to determine the direction and extent of movement of the sprinkler head means to thereby determine the direction and extent the instantaneous generally segmental ground pattern of the dispersed water is moved within said circular pattern, said pattern control assembly being operable after the sprinkler head means has been manually moved beyond either determined extent of movement to automatically return the sprinkler head means within the determined extents of movement during subsequent operation, the improvement which comprises said pattern control assembly comprising:

an outer annular member having annular exterior eripheral surface means and annular interior surface means, an inner member having means for mounting the same for annular movement in one direction and in an opposite direction in cooperating relation with the reversible drive means of the sprinkler assembly so that (1) a predetermined annular movement of said inner member in one direction is operable o effect a reversal of said reversible drive means so as to reverse the movement of the sprinkler head means of the sprinkler assembly and the instantaneous generally segmental ground pattern of the discharged water from one direction to an opposite direction and (2) a predetermined annular movement of said inner member in an opposite direction is operable to effect a reversal of said reversible drive means to reverse the movement of the sprinkler head means of the sprinkler assembly and the instantaneous generally segmental ground pattern to the discharged water from said opposite direction Lo said one direction, said inner member having annularly arranged resiliently yieldable finder means operable in response to a relative axial movement between said inner and puter members from separate positions into cooperating positions to cooperate with the interior peripheral surface means of said outer member to retain said members in their cooperating positions, first and second adjustable members mounted on the exterior peripheral surface means of said outer member for (1) selective annular movement with respect to said outer member by manual adjustment into any selected one of a multiplicity of different part circle pattern defining positions and (2) annular motion transmitting relation with respect to said out member so that (A) movement of the sprinkler head means in said one direction into said first member transmits a corresponding annular movement said outer member in one direction and (B) movement of the sprinkler head means in said opposite direction into said second member transmits a corresponding annular movement to said outer member in an opposite direction and interengaging surface means between said spring finger means and said interior peripheral surface means operable to be (1) engageable to transmit perative sprinkler head means causing annular movements of said outer member in either direction to corresponding movements of said inner member and (2) yieldably disengageable in response to manually caused overriding annular movements of said outer member in either direction so as to enable said outer member to be manually moved relative to said inner member.

28. The adjustable part circle sprinkler assembly as defined in claim 27 wherein said inner and outer members and said first and second adjustable members are molded of plastic material.

29. The adjustable part circle sprinkler assembly as defined in claim 28 wherein each of said adjustable members is of elongated configuration having a central arcuate portion of substantial arcuate extent, a relatively long end portion extending radially outwardly iron one end of said central arcuate portion and a relatively short end portion extending radially outwardly from the opposite end of said central arcuate portion, said central arcuate portion having serrated surface means on the interior periphery thereof, the annular exterior peripheral surface means of said outer member having axially extending ridge means thereon for engaging the serrated surface means of each adjustable member so that the force required to effect said selective annular movement by manual adjustment of the long end portion of each adjustable member is substantially greater in a direction toward the associated short end portion than in a direction away from the associated short end portion, said first and second adjustable members being arranged on the exterior peripheral surface means of said outer member with the long end portions positioned correspondingly with the arcuate extent of the predetermined part circle pattern and the short end portions disposed therebeyond.

30. The adjustable part circle sprinkler assembly as defined in claim 29 sad interengaging surface means is provided by a single groove in said interior peripheral surface means and a single groove entering projection on said spring finger means.

31. adjustable part circle sprinkler assembly comprising sprinkler body means having inlet means for communication of water under pressure therewith, sprinkler head means mounted on said sprinkler body means for rotational movement about an upright axis having outlet means for directing water communicated with said inlet means in an upwardly and outwardly extending stream formation so as to be dispersed in an instantaneous generally segmental ground pattern within a circular ground pattern, reversible drive means operable by the water flowing through said sprinkler body means and said sprinkler head means between said inlet means and said outlet means for moving said sprinkler head means about said upright axis in either direction, said sprinkler head means including a tubular top portion defining an interior space opening upwardly, manually adjustable means within said interior space cooperable with the reversible drive means to determine the direction and extent of movement of the sprinkler head means to thereby determine the direction and extent the instantaneous generally segmental ground pattern of the dispersed water is moved within said circular pattern, a cap structure and means mounting said cap structure for (1) engagement with said tubular top portion in closing relation with the upwardly opening interior space thereof and (2) removal from a tubular top portion so as to permit manual access to said adjustable means within said interior space, said mounting means comprising interengaging lug means on said cap structure and said tubular top portion for (1) enabling said cap structure to be engaged with said tubular top portion in closing relation with respect to the upwardly opening interior space thereof in such a way that said cap structure is generally unrestrictively rotatable in either direction sc as to permit unwanted manual rotation thereof without a commensurate rotational movement of said tubular top portion and (2) enabling said cap structure to be disengaged from said tubular top portion to expose the upwardly opening interior space thereof by a manual prying action only when said cap structure is within a limited range of annular positions with respect to said tubular top portion.

32. The improvement as defined in claim 31 wherein said cap structure includes a disk shaped member molded of plastic material, the lug means on said cap structure including a series of annularly arranged arcuate lugs integral with and extending in an axial direction from one side of said disk shaped member along an exterior marginal edge portion thereof, said lugs providing exterior arcuate surfaces extending from said disk shaped member, certain of said lugs having locking surfaces facing toward said disk shaped member and extending outwardly from the exterior arcuate surface thereof and inclined cam surfaces extending from said locking surfaces to the free ends of said lugs.

33. The improvement as defined in claim 32 wherein said cap structure includes a rubber cover extending ver the other side of said disk shaped member and around the exterior marginal edge portion thereof.

34. The improvement as defined in claim 33 wherein said plurality of lugs are closely spaced and include three adjacent lugs, the one central lug of which provides said locking and cam surfaces and the other two spaced lugs of which are devoid of said locking and cam surfaces, the lug means on said tubular top portion projecting inwardly along an upper interior periphery thereof such that only one arcuate section thereof is devoid of lug means for an arcuate extent greater than the arcuate extent of said one central lug, the lug means extending substantially throughout the remaining section of the interior periphery of said top portion and having surfaces cooperating with the locking and cam surfaces of said cap structure lugs.

* * * * *